US008327760B2

(12) United States Patent
Takahashi et al.

(10) Patent No.: US 8,327,760 B2
(45) Date of Patent: Dec. 11, 2012

(54) CAM SLIDER SHOCK ABSORBING MEMBER IN CAM DEVICE AND MOUNTING METHOD THEREOF

(75) Inventors: Hiromi Takahashi, Tokyo (JP); Takashi Shibata, Tokyo (JP)

(73) Assignee: Sankyo Oilless Industry, Inc., Tokyo (JP)

( * ) Notice: Subject to any disclaimer, the term of this patent is extended or adjusted under 35 U.S.C. 154(b) by 427 days.

(21) Appl. No.: 12/614,501

(22) Filed: Nov. 9, 2009

(65) Prior Publication Data

US 2010/0242750 A1 Sep. 30, 2010

(30) Foreign Application Priority Data

Mar. 27, 2009 (JP) ..... 2009-078916

(51) Int. Cl.
*B30B 1/00* (2006.01)
*B21D 5/01* (2006.01)
*B21D 37/08* (2006.01)

(52) U.S. Cl. ..... 100/265; 72/315; 72/452.9

(58) Field of Classification Search ..... 100/265, 100/266, 291; 72/315, 452.9; 74/110, 567; 29/428

See application file for complete search history.

(56) References Cited

U.S. PATENT DOCUMENTS

| | | | | |
|---|---|---|---|---|
| 5,101,705 | A * | 4/1992 | Matsuoka | 83/588 |
| 5,881,599 | A * | 3/1999 | Sasahara et al. | 74/110 |
| 6,220,137 | B1 * | 4/2001 | Matsuoka | 83/627 |
| 6,990,844 | B1 * | 1/2006 | Fidziukiewicz | 72/452.9 |
| 7,243,524 | B2 * | 7/2007 | Kinoshita | 72/381 |

FOREIGN PATENT DOCUMENTS

| | | |
|---|---|---|
| JP | 2000-218320 | 8/2000 |

* cited by examiner

*Primary Examiner* — Jimmy T Nguyen
(74) *Attorney, Agent, or Firm* — Wenderoth, Lind & Ponack, LLP.

(57) ABSTRACT

In order to provide a cam slider shock absorbing member for a cam device which realizes a sufficient stroke, easy replacement, a compact profile, and an easy-to-machine property without necessity of adhesive agent, the shock absorbing member includes a mounting portion having an external dimension at least larger than an internal dimension of a mounting hole on the side of a lower end thereof and a deflecting portion having a predetermined distance for a deflecting margin with respect to an inner wall surface of the mounting hole on the upper side of the mounting portion, and an upper end of the deflecting portion projects upward from an opening end of the mounting hole and being formed to have a height which secures a length corresponding to the stroke to be compressed.

20 Claims, 5 Drawing Sheets

CAM SLIDER SHOCK ABSORBING MEMBER IN CAM DEVICE AND MOUNTING METHOD THEREOF

BACKGROUND OF THE INVENTION

1. Field of the Invention

The present invention relates to a shock absorbing member which alleviates an impact generated with respect to a cam slider supporting base when a cam slider configured to be slid in the horizontal direction on a cam surface of a cam driver for machining is returned to its original position, and a method of mounting the same, in a cam device of a press die.

2. Prior Art

Conventionally, in a case where a large metallic panel such as an automotive vehicle body is press-formed with a die including a lower fixed die and an upper movable die in terms of the vertical direction, a cam device as shown in FIGS. 6A and 6B, for example, is mounted on the die in order to form a hole on a side surface of a press-formed product or bend an edge of the same.

The cam device is a so-called aerial cam device, and includes a cam driver 2 configured to be fixedly mounted on a fixed die A, a cam slider 3 having a cam surface 3*a* which comes into sliding contact with a sliding surface 2*a* of the cam driver 2 and a machining tool, and a cam slider supporting base 4 configured to be mounted on a movable die B which moves upward and downward and is configured to movably support the cam slider 3 (see JP-A-2000-218320).

Provided between a rear end portion of the cam slider 3 and a one-side supporting strip of the cam slider supporting base 4 is a shock absorbing unit 10 configured to alleviate an impact generated when the cam slider 3 is returned to its original position by an urging force of a resilient member 5 such as a coil spring when the movable die B is moved from a closed position (see FIG. 6B) to an open position (see FIG. 6A).

The shock absorbing unit 10 having a shock absorbing member 11 formed into a cylindrical shape with a urethane material which is inserted into a mounting hole 4*a* of the cam slider supporting base 4, and is attached and fixed with adhesive agent 12 is known as shown in FIG. 7A. As shown in FIG. 7B, there is also a shock absorbing member 13 being formed of a urethane material and having a leg portion 13*b* inserted into the mounting hole 4*a* of the cam slider supporting base 4 and fixed thereto or screwed therein so that an outside portion corresponds to a deflecting margin portion 13*a* having a diameter larger than the mounting hole 4*a* added with a height including a compression stroke "s" set therein. Furthermore, there is a known shock absorbing member 14 having a through hole at a center portion thereof to allow a bolt 15 and a collar 16 to be inserted therein, thereby screwing into the cam slider supporting base 4 as shown in FIG. 7C.

However, in the above conventional cam slider shock absorbing member of the cam device, for example, in an example shown in FIG. 7A, the stroke "s" cannot be set to large value, and the adhesive agent 12 is needed. Therefore, it takes a lot of trouble to execute the work and, in addition, the shock absorbing member cannot be replaced easily and is easy to break. In an example shown in FIG. 7B, a protruding amount a from a wall surface 4*b* of the cam slider supporting base 4 is large and hence a space required for the shock absorbing member is increased. In addition, since an exposed portion is large, it can easily come apart by application of an external force. In an example shown in FIG. 7C, the number of components such as the bolt and the collar is increased, and hence the cost is increased and, in addition, it takes a lot of trouble to execute the work such as installation of the shock absorbing member or formation of the screw hole.

SUMMARY OF THE INVENTION

In view of such problems as described above, it is an object of the invention to provide a cam slider shock absorbing member in a cam device which realizes a sufficient stroke, easy replacement, a compact profile, and an easy-to-machine property without necessity of adhesive agent, and a mounting method thereof.

Accordingly, there is provided an invention of a cam slider shock absorbing member of a cam device mounted on a fixed die and a movable die moving upward and downward to be provided for machining of a press formed product, including: a cam driver secured to one of the dies; a cam slider provided on the cam driver and configured to move in a predetermined direction by the cam driver; and a cam slider supporting base secured to the other die and configured to slidably support the cam slider, the cam slider having a resilient member configured to restore the cam slider to an original position following a cam action, and a shock absorbing member mounted in a mounting hole formed on a one-side supporting strip of the cam slider supporting base, the shock absorbing member being configured to alleviate an impact generated when the cam slider is returned to the original position, wherein the shock absorbing member includes a mounting portion having an external dimension at least larger than an internal dimension of the mounting hole on the side of a lower end thereof and a deflecting portion having a predetermined distance for a deflecting margin with respect to an inner wall surface of the mounting hole on an upper side of the mounting portion, and an upper end of the deflecting portion projects upward from an opening end of the mounting hole and being formed to have a height which secures a length corresponding to a stroke to be compressed.

Preferably, the mounting portion of the cam slider shock absorbing member is formed into a cylindrical shape or a quadratic prism shape, and a vertical cross-sectional shape of the entire portion thereof is formed substantially into any one of a protruding shape, a trapezoidal shape, a bombshell shape, and a hand drum shape.

Preferably, a through hole penetrating through a center thereof in the vertical direction is formed for adjusting a compression stress.

The cam slider shock absorbing member configured as described above is mounted by press-fitting into a mounting hole for the shock absorbing member having an air vent port provided on a cam slider supporting base from the side of a mounting portion thereof with a press-fitting jig. Preferably, a surface of an inner peripheral wall, which corresponds to a sliding surface, of the mounting hole for the shock absorbing member is machined rougher than a normal finishing; and an air vent port is formed on a bottom surface of the mounting hole for the shock absorbing member so as to penetrate therethrough to the outside; and the shock absorbing member is mounted in the mounting hole.

According to the cam slider shock absorbing member of the cam device of the invention, since the mounting portion of the shock absorbing member is formed to have the external dimension larger than the internal dimension of the mounting hole of the cam slider supporting base to which the mounting portion of the shock absorbing member is to be mounted, and the deflecting portion of the shock absorbing member is formed to be smaller than the mounting portion and project from the opening end of the mounting hole, and to have the height which secures the length corresponding to the stroke to be compressed, the cam slider shock absorbing member which realizes a sufficient stroke, easy replacement, a compact profile, and an easy-to-machine property without necessity of adhesive agent, and a mounting method thereof, are provided.

Since the shock absorbing member is press-fitted into the mounting hole of the cam slider supporting base from the mounting portion of the shock absorbing member with the press-fitting jig, mounting work is achieved easily. Also, since the peripheral wall surface of the mounting hole of the cam slider supporting base to which the shock absorbing member is to be press-fitted is roughly finished, the strength of fixation of the shock absorbing member can be improved. Also, since the air vent port is provided on the bottom surface of the mounting hole, the press-fitting work of assembling the shock absorbing member can be performed smoothly.

DETAILED DESCRIPTION OF THE PREFERRED EMBODIMENTS

Figure 1:
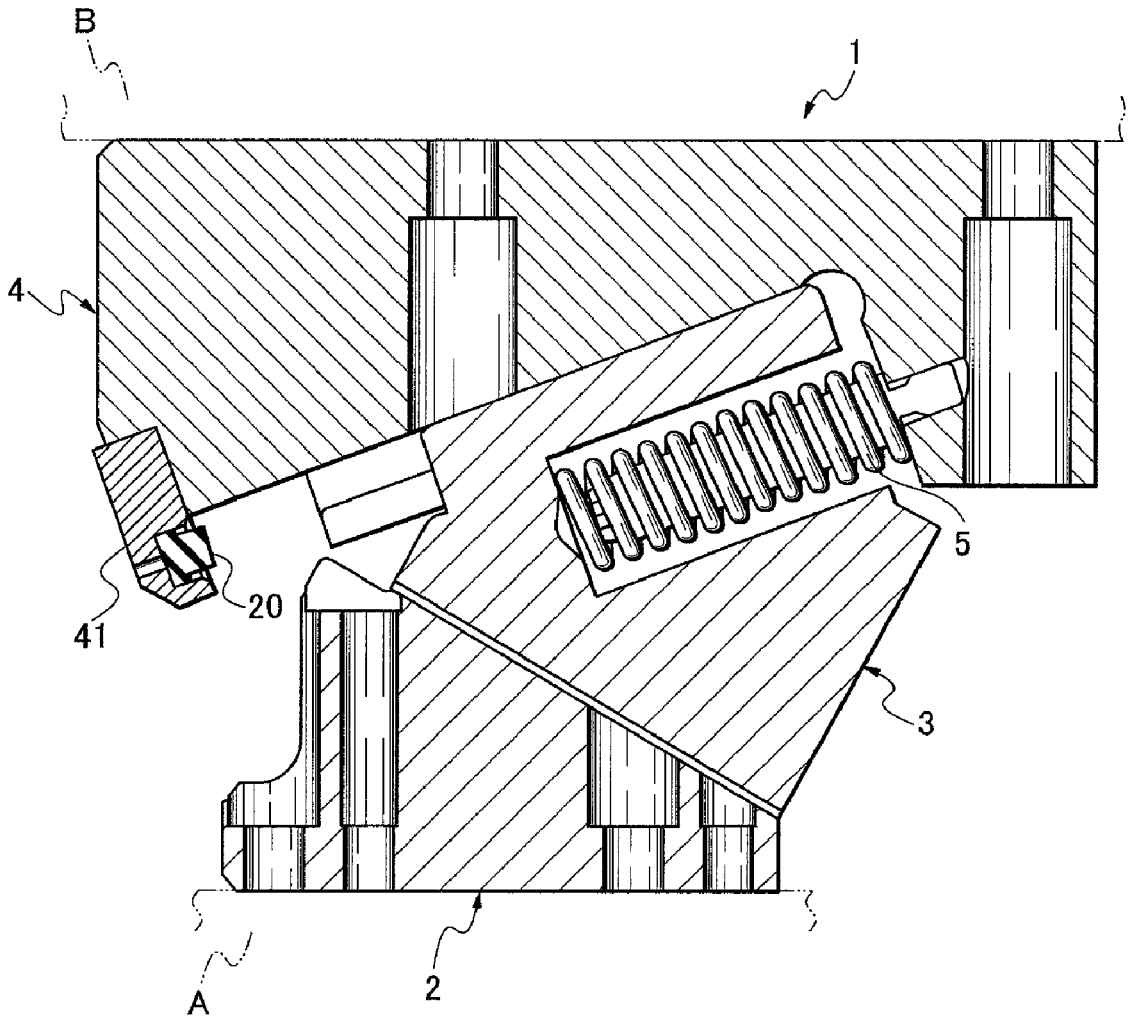
FIG. 1 is a vertical cross-sectional view showing a cam device in which a cam slider shock absorbing member according to the invention is employed.

A cam slider shock absorbing member according to the invention is used in a cam device 1 in a press die as shown in FIG. 1 for example. The cam device 1 includes a cam driver 2 secured to a fixed die A, a cam slider 3 provided on the cam driver 2 and configured to move in a predetermined direction by the cam driver 2, and a cam slider supporting base 4 secured to a movable die B which moves upward and downward and configured to slidably support the cam slider 3. A cam surface on a lower surface of the cam slider 3 comes into slidable contact with a sliding surface on the cam driver 2, the cam slider 3 is moved in a machining direction in association with a downward movement of the movable die B, and the machining is performed by a tool attached to the cam slider 3.

The cam slider 3 having completed the machining operation and being at a closed position is returned to its original position, which is an open position, in association with an upward movement of the movable die B, by a coil spring 5 as a resilient member arranged between the cam slider 3 and the cam slider supporting base 4. Provided between a rear end portion of the cam slider 3 and a one-side supporting strip 41 of the cam slider supporting base 4 is a shock absorbing member 20 configured to alleviate an impact generated when the cam slider is returned to its original position.

Figure 2:
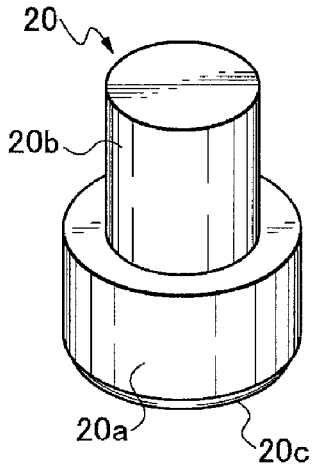
FIG. 2 is a perspective view showing the cam slider shock absorbing member according to a first embodiment.

FIG. 2 shows the shock absorbing member 20 according to a first embodiment, which is formed into a cylindrical shape having a protruded shape in cross-section, which includes a mounting portion 20*a* formed to have a larger diameter, and a deflecting portion 20*b* formed to have a smaller diameter. The mounting portion 20*a* is formed to have an external dimension which is larger than an internal dimension of a mounting hole 41*a* formed in the one-side supporting strip 41 of the cam slider supporting base 4, and is press-fitted into the mounting hole 41*a* when being mounted. The deflecting portion 20*b* is formed to be smaller than the mounting portion 20*a*, and also smaller than the internal diameter of the mounting hole 41*a*, and to have a height to make an upper end project from an opening end 41*b* of the mounting hole 41*a* and to secure a length corresponding to an amount of a stroke "s" to be compressed (on the order of 4 to 5 mm, for example). The diameter of the deflecting portion 20*b* is formed to be smaller than the internal diameter of the mounting hole 41*a* to an extent that a deflecting margin upon receipt of a pressure from the cam slider 3 is sufficiently secured in an internal space of the mounting hole 41*a*.

Figure 3A:
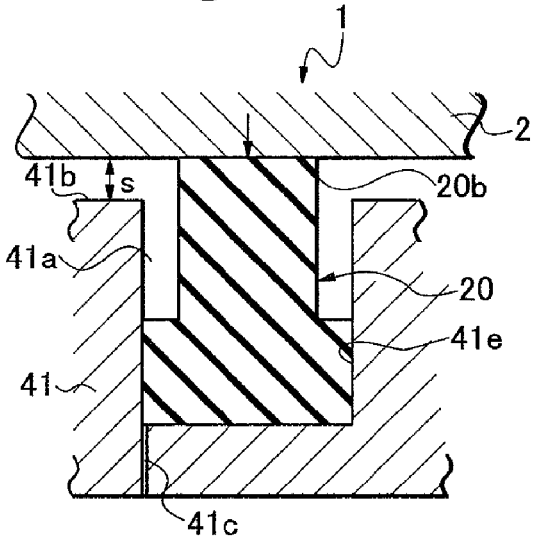
FIG. 3A is a vertical cross-sectional view showing a state in which the shock absorbing member is mounted on a mounting hole of a cam slider supporting base.
Figure 3B:
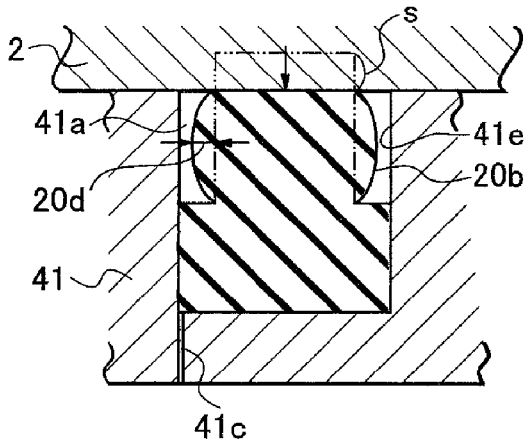
FIG. 3B is a vertical cross-sectional view showing a state in which a cam slider compresses the cam slider shock absorbing member and comes into abutment with a wall surface of the cam slider supporting base.

The shock absorbing member 20 is a single, unitary resilient member (as shown in FIGS. 3A and 3B) formed of urethane or rubber, and the hardness thereof is on the order of approximately 70 to 90 in Shore Hardness (HS). Also, a circumferential edge of a distal end portion 20*c* of the mounting portion 20*a* of the shock absorbing member 20 is beveled to facilitate the press-fitting work. In contrast, a bottom surface of the mounting hole 41*a* of the cam slider supporting base 4 to which the shock absorbing member 20 is press-fitted is formed with an air vent port 41*c* communicated with the outside. Furthermore, an inner peripheral wall surface 41*e* of the mounting hole 41*a* is roughly finished to a state in which the shock absorbing member 20 can hardly slip.

When mounting the cam slider shock absorbing member configured as described above, the shock absorbing member 20 is press-fitted into the mounting hole 41*a* with a press-fitting jig from a distal end of the mounting portion 20*a*. Here, since the external dimension of the shock absorbing member 20 is set to be larger than the internal diameter of the mounting hole 41*a* by about 0.1%, the shock absorbing member 20 is tightly fixed to the bottom surface of the mounting hole 41*a* as shown in FIGS. 3A and 3B. Therefore, it is not necessary to use adhesive agent or the like. Since the air in the interior of the mounting hole 41*a* is introduced to the outside from the air vent port 41*c* simultaneously with the press-fitting, the shock absorbing member 20 can be press-fitted into the bottom surface smoothly without resistance by the air pressure.

The shock absorbing member 20 fixed to the mounting hole 41*a* is compressed by about 4 to 5 mm when the cam slider 3 is restored to its initial position. Although the deflecting portion 20*b* of the shock absorbing member 20 is deflected and protruded toward the outer periphery by the compression, since a deflecting margin 20*d* is sufficiently secured in the internal space of the mounting hole 41*a*, the stroke S can be elongated. Since the adhesive agent is not used, replacement of the shock absorbing member 20 is achieved only by pulling the same with a jig, and hence the operation is easy. Also, since most part of the shock absorbing member 20 is stored in the interior of the mounting hole 41*a*, breakage can hardly occur.

Figure 4A:
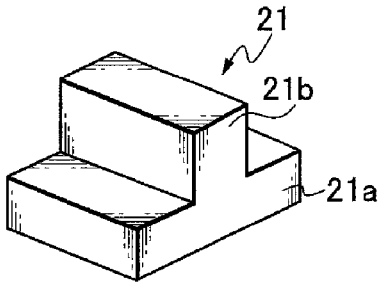
FIG. 4A is a perspective view of the cam slider shock absorbing member according to a second embodiment.
Figure 4B:
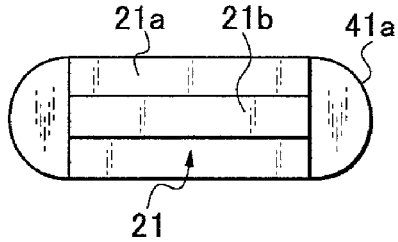
FIG. 4B is a plan view of the same in a state of being press-fitted into an elongated mounting hole.

The shock absorbing member may be shaped as shown in FIGS. 4A, 4B, and 5A to 5F, instead of the cylindrical shape in the embodiment described above. In other words, FIGS. 4A and 4B show a shock absorbing member 21 according to a second embodiment, which includes a mounting portion 21*a* and a deflecting portion 21*b* of a parallelepiped shape. The shock absorbing member 21 as described above is suitable in a case where the mounting hole 41*a* of the cam slider supporting base 4 is an elongated hole or an oval hole as shown in FIG. 4B.

Figure 5A:
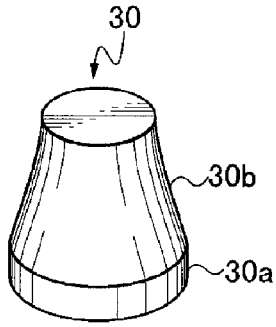
FIG. 5A is a perspective view showing the shape of the cam slider shock absorbing member according to a third embodiment.
Figure 5B:
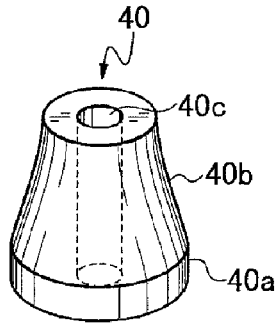
FIG. 5B is a perspective view showing the shape of the cam slider shock absorbing member according to a fourth embodiment.

FIG. 5A shows a shock absorbing member 30 according to a third embodiment, which achieves a longer stroke because a distal end portion of a deflecting portion 30*b* of a substantially truncated conical shape formed on a cylindrical-shaped mounting portion 30*a* is tapered. FIG. 5B shows a shock absorbing member 40 according to a fourth embodiment, in which a mounting portion 40*a* and a deflecting portion 40*b* are the same as those in the third embodiment. However, the shock absorbing member 40 includes a through hole 40*c* penetrating the center portion thereof in the vertical direction, and hence the adjustment of a compression stress is simplified.

Figure 5C:
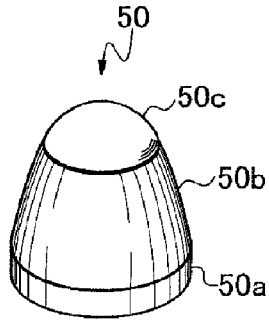
FIG. 5C is a perspective view showing the shape of the cam slider shock absorbing member according to a fifth embodiment.
Figure 5D:
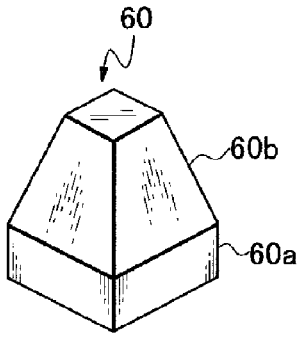
FIG. 5D is a perspective view showing the shape of the cam slider shock absorbing member according to a sixth embodiment.

FIG. 5C shows a shock absorbing member 50 according to a fifth embodiment, which is formed into a substantially bombshell shape as a whole and includes a cylindrical-shaped mounting portion 50*a*, a deflecting portion 50*b* of a substantially truncated conical shape, and a head portion 50*c* of a semi-spherical shape, and is a shock absorbing member having a small resistance at the beginning of contact. FIG. 5D shows a shock absorbing member 60 according to a sixth embodiment, which includes a mounting portion 60*a* of a quadratic prism shape and a deflecting portion 60*b* of a truncated pyramid shape.

Figure 5E:
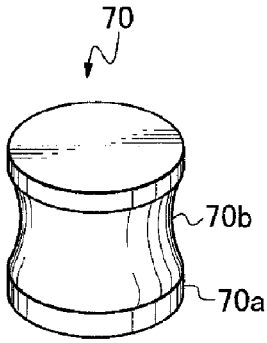
FIG. 5E is a perspective view showing the shape of the cam slider shock absorbing member according to a seventh embodiment.
Figure 5F:
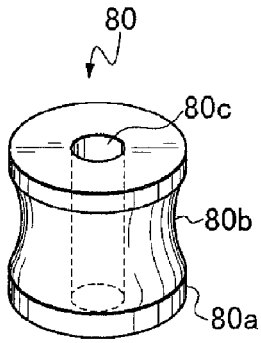
FIG. 5F is a perspective view showing the shape of the cam slider shock absorbing member according to a eighth embodiment.
Figure 6A:
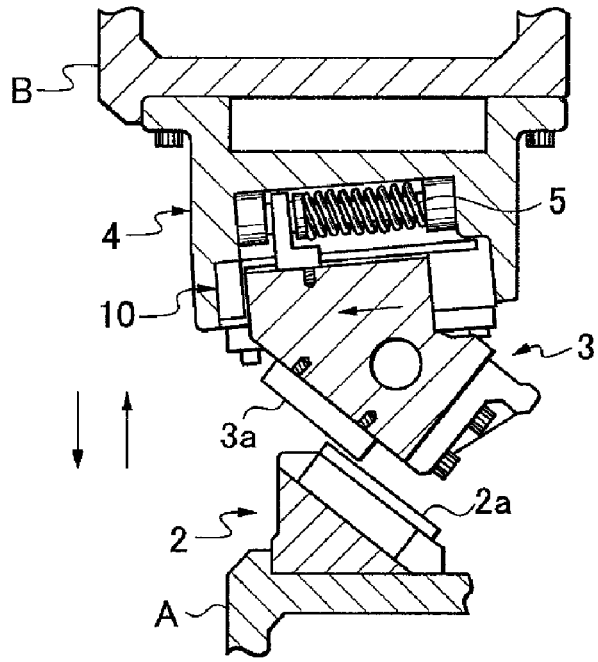
Fig. 6A PRIOR ART
FIGS. 6A and 6B are vertical cross-sectional views showing states of usage of a shock absorbing member in a cam device in the prior art.
Figure 6B:
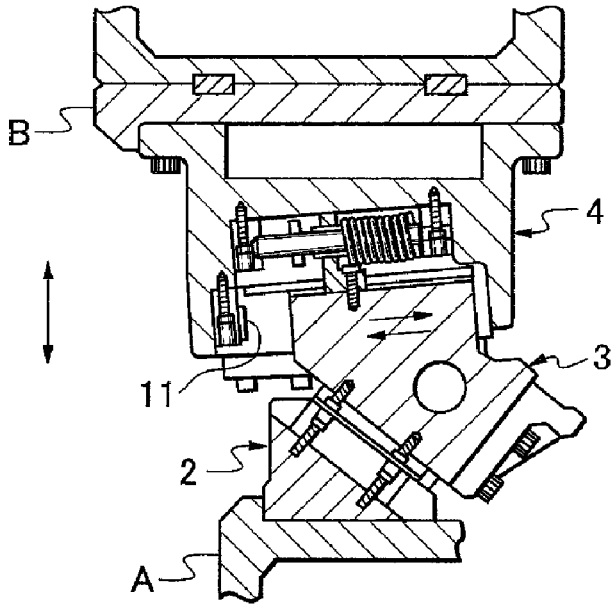
Fig. 6B PRIOR ART
Figure 7A:
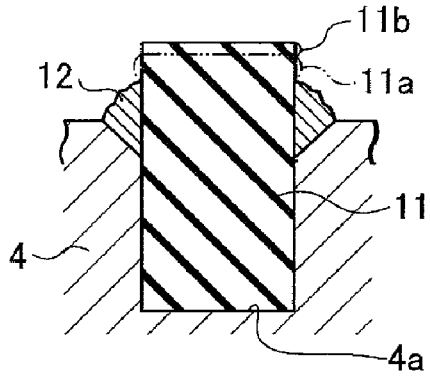
Fig. 7A PRIOR ART
FIGS. 7A to 7C are vertical cross-sectional views showing states of usage of a cam slider shock absorbing member in the related art.
Figure 7B:
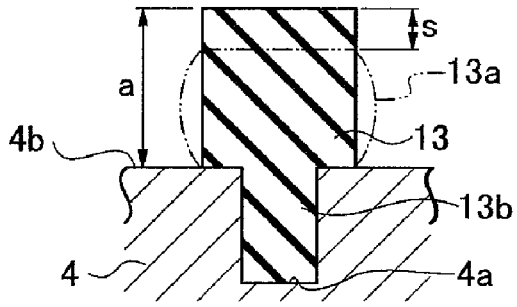
Fig. 7B PRIOR ART
Figure 7C:
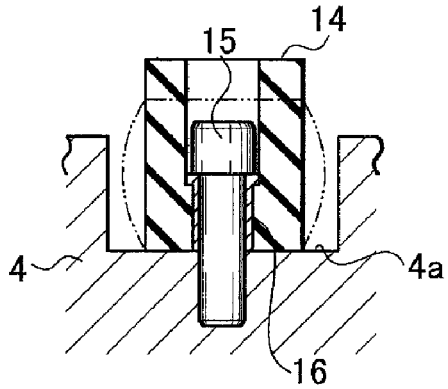
Fig. 7C PRIOR ART

FIG. 5E shows a shock absorbing member 70 according to a seventh embodiment, which is formed into a substantially hand drum shape as a whole, and includes a cylindrical-shaped mounting portion 70*a* and a deflecting portion 70*b* being narrowed into a substantially hand drum shape, so that the deflecting portion 70*b* is easily deflected. FIG. 5F shows the shock absorbing member 70 according to the eighth embodiment formed with a through hole 80*c* penetrating through a center portion thereof in the vertical direction, which is a shape to allow easy adjustment of the compression stress.

The shock absorbing member according to the invention is effective for alleviating the impact generated by a returning action of the cam slider in the cam device, and is also effective as the shock absorbing member of a moving member which generates an impact sound.

What is claimed is:

1. A cam slider shock absorbing member configured to be provided in a cam device mounted on a fixed die and a movable die moving upward and downward to be provided for machining of a press-formed product, the cam device including a cam driver secured to one of the dies, a cam slider provided on the cam driver and configured to move in a predetermined direction by the cam driver, and a cam slider supporting base secured to the other die and configured to slidably support the cam slider, the cam slider having a resilient member configured to restore the cam slider to an original position following a cam action, wherein the shock absorbing member is configured to be mounted in a mounting hole formed in a one-side supporting strip of the cam slider supporting base, the shock absorbing member being configured to alleviate an impact generated when the cam slider is returned to the original position, the shock absorbing member having:

a mounting portion formed to have an external dimension at least larger than an internal dimension of the mounting hole on the side of a lower end thereof so that the mounting portion can be press-fit in the mounting hole; and a deflecting portion having an external dimension smaller than an external dimension of the mounting portion, and being configured so that a predetermined distance is provided as a deflecting margin between the deflecting portion and an inner wall surface of the mounting hole on the upper side of the mounting portion, and so that an upper end of the deflecting portion projects upward from an opening end of the mounting hole and being formed to have a height which secures a length corresponding to a stroke to be compressed, and the upper end of the deflecting portion being pushed down to the same level as the opening end of the mounting hole when the cam driver presses against the open end of the mounting hole.

2. The cam slider shock absorbing member according to claim 1, wherein the mounting portion of the cam slider shock absorbing member is formed into a cylindrical shape or a quadratic prism shape.

3. The cam slider shock absorbing member according to claim 1, wherein a vertical cross-sectional shape of the entire portion thereof is formed substantially into any one of a protruding shape, a trapezoidal shape, a bombshell shape, and a hand drum shape.

4. The cam slider shock absorbing member according to claim 3, comprising a through hole penetrating through a center thereof in the vertical direction.

5. The cam slider shock absorbing member according to claim 1, wherein the shock absorbing member is a single unitary member such that the mounting portion and the deflecting portion of the shock absorbing member are two united portions of the single unitary member.

6. The cam slider shock absorbing member according to claim 5, wherein the single unitary member is formed of a resilient material.

7. The cam slider shock absorbing member according to claim 6, wherein the resilient material of the single unitary member is urethane or rubber.

8. The cam slider shock absorbing member according to claim 5, wherein the mounting portion of the cam slider shock absorbing member is formed into a cylindrical shape or a quadratic prism shape.

9. The cam slider shock absorbing member according to claim 5, wherein a vertical cross-sectional shape of the entire portion thereof is formed substantially into any one of a protruding shape, a trapezoidal shape, a bombshell shape, and a hand drum shape.

10. The cam slider shock absorbing member according to claim 9, comprising a through hole penetrating through a center thereof in the vertical direction.

11. A cam slider shock absorbing arrangement configured to be provided in a cam device mounted on a fixed die and a movable die moving upward and downward to be provided for machining of a press-formed product, the cam device including a cam driver secured to one of the dies, a cam slider provided on the cam driver and configured to move in a predetermined direction by the cam driver, and a cam slider supporting base secured to the other die and configured to slidably support the cam slider, the cam slider having a resilient member configured to restore the cam slider to an original position following a cam action, the shock absorbing arrangement including:

a one-side supporting strip to be provided on the cam slider supporting base, the one-side supporting strip having a mounting hole formed therein; and a shock absorbing member mounted in the mounting hole formed in the one-side supporting strip, the shock absorbing member being configured to alleviate an impact generated when the cam slider is returned to the original position, the shock absorbing member having a mounting portion that has an external dimension at least larger than an internal dimension of the mounting hole on the side of a lower end thereof so that the mounting portion is press-fit in the mounting hole, and a deflecting portion having an external dimension smaller than an external dimension of the mounting portion, and being configured so that a predetermined distance is provided as a deflecting margin between the deflecting portion and an inner wall surface of the mounting hole on the upper side of the mounting portion, and so that an upper end of the deflecting portion projects upward from an opening end of the mounting hole to have a height which secures a length corresponding to a stroke to be compressed, and the upper end of the deflecting portion being pushed down to the same level as the opening end of the mounting hole when the cam driver presses against the open end of the mounting hole.

12. The cam slider shock absorbing arrangement according to claim 11, wherein the mounting portion of the shock absorbing member is formed into a cylindrical shape or a quadratic prism shape.

13. The cam slider shock absorbing arrangement according to claim 11, wherein a vertical cross-sectional shape of the entirety of the shock absorbing member is formed substantially into any one of a protruding shape, a trapezoidal shape, a bombshell shape, and a hand drum shape.

14. The cam slider shock absorbing arrangement according to claim 13, wherein a through hole penetrates through a center of the shock absorbing member in the vertical direction.

15. The cam slider shock absorbing arrangement according to claim 11, wherein the shock absorbing member is a single unitary member such that the mounting portion and the deflecting portion of the shock absorbing member are two united portions of the single unitary member.

16. The cam slider shock absorbing arrangement according to claim 15, wherein the single unitary member is formed of a resilient material.

17. The cam slider shock absorbing arrangement according to claim 16, wherein the resilient material of the single unitary member is urethane or rubber.

18. The cam slider shock absorbing arrangement according to claim 15, wherein the mounting portion of the cam slider shock absorbing member is formed into a cylindrical shape or a quadratic prism shape.

19. The cam slider shock absorbing arrangement according to claim 15, wherein a vertical cross-sectional shape of an entirety of the shock absorbing member is formed substantially into any one of a protruding shape, a trapezoidal shape, a bombshell shape, and a hand drum shape.

20. The cam slider shock absorbing arrangement according to claim 19, wherein a through hole penetrates through a center of the shock absorbing member in the vertical direction.

* * * * *